US006347652B1

(12) United States Patent
Hunter

(10) Patent No.: US 6,347,652 B1
(45) Date of Patent: Feb. 19, 2002

(54) MACHINE FOR PLANING LARGE WOOD TIMBERS

(75) Inventor: Scott A Hunter, Alton, NH (US)

(73) Assignee: Scott A. Hunter, Alton, NH (US)

( * ) Notice: Subject to any disclaimer, the term of this patent is extended or adjusted under 35 U.S.C. 154(b) by 0 days.

(21) Appl. No.: 09/618,667

(22) Filed: Jul. 18, 2000

(51) Int. Cl.[7] ..... B27C 1/00

(52) U.S. Cl. ..... 144/117.4; 30/475; 144/114.1; 144/246.1

(58) Field of Search ..... 144/114.1, 117.4, 144/246.1; 30/475; 409/175, 178, 181, 182

(56) References Cited

U.S. PATENT DOCUMENTS 3,207,195 A * 9/1965 Anton ..... 144/117.4 X
3,253,624 A * 5/1966 Fegan et al. ..... 144/117.4 X
5,287,660 A * 2/1994 Bellati et al. ..... 144/117.4 X
5,778,950 A * 7/1998 Wrightman ..... 30/475 X

FOREIGN PATENT DOCUMENTS

GB 325745 * 2/1930 ..... 144/117.4
GB 328411 * 5/1930 ..... 144/117.4

* cited by examiner

*Primary Examiner*—W. Donald Bray

(57) ABSTRACT

A machine for planing large wood timbers or other heavy wood products easily by self-propelling along the work piece and planing the wood surface as it goes. The machine has a set of planer knives driven by a power source, a set of rollers before and after the knives for self feeding the planer down the work, and a flat surface in front and behind the rollers and cutting knives for stability and smoothness. The roller may also be adjusted in relation to the cutters for depth of cut and/or slightly angling the cut to one side. Centering guides keep the unit balanced on the work piece. There can be multiple feed rollers in front and behind the planer knives.

2 Claims, 2 Drawing Sheets

MACHINE FOR PLANING LARGE WOOD TIMBERS

BACKGROUND OF THE INVENTION

This invention relates generally to the field of wood producing, and more particularly to a machine for planing large wood timbers easily.

Wood planers have been around for a while in different sizes. Modern mechanical planers consist of a stationary frame, a bed that can be moved up and down, feed rollers, a feeding mechanism, and a cylindrical cutting head holding three or more knives that pare off the excess wood. Models range from single planers which smooth one surface of a board at a time, to machines that can finish several surfaces simultaneously, e.g. double planers and four-sided planers, these latter machines being designed for putting high quality finish on lumber. Currently feed-speeds of up to 2000 fpm are available. (ref.: 1998 Product Guide, Newman Whitney). Further planers are also identified by the length of their cutting blades, such that a planer employing two 12" cutting blades would be described a 12" planer. These methods need other equipment to help move the timbers around and are expensive.

Hand planes, or hand-held planing instruments, have been known and used from early times by carpenters in order to remove rough surfaces on wood and for reducing it to size. An iron-soled carpenter's plane, found on the site of a Roman town in Hampshire, England, dates from before AD 400 (ref.: Encyclopedia Britannica, 1991, v.9,p.495) Hand planes are used, to this time, for smaller jobs and for requiring ease of handling, as the feed stock does not have to be moved around as with the stationary planers and do not need to be fed into a stationary machine, Clearly, one of the disadvantages of a hand plane is that physical effort is required in operation.

Makita, Black and Decker and others came out with small hand held electric planers in the early 1970's. The knives can be 3½" long to 12" long depending on the size of the work you need smoothed and they work well for what they are made to do but if there is a lot of surface to be planed they are not practical.

One of the earliest patents for small hand power planers can be found in the US Patents and Trademarks Office (POT) database: U.S. Pat. No. 4,363,343, issued December 1992 to Guise Coon, assigned to Black & Decker Inc. These are usually small and lightweight but Makita and others have made them with 12" knives for larger surfaces.

There are also floor model planers made by Delta, Dewalt, Belsaw and many others that would be used in wood working shops and there are very large industrial planers that would usually be set up at a large mill or other industrial site.

There are many timber framing companies, log home builders, general contractors and smaller saw mills that work with rough sawed post and beam material. They can either bring this material to a large planer mill to have them done, use a floor model not really made for such heavy material, or use the hand held models that are really made for touch up work. Some of the limitations in using the planers available today are, when using the services of a large planer mill, the timbers must be trucked to and from the facility and the process is very expensive for the limited amount of timbers used in the average house.

When using a floor model shop type planer the user must have enough room on each side of the machine to feed in and feed out the timbers and the timbers must be handled by man power or by support equipment making it difficult in a smaller woodworking shop to plane long timbers.

While using a hand held surface planer is great for small touch up work it is to labor intensive to use on larger quantities of timbers and often the sole of the planer picks up sap and makes it hard to push by hand.

SUMMARY OF THE INVENTION

The primary object of the invention is to plane large and long wood timbers in a small shop.

Another object of the invention is to be portable and light enough for one person to operate more easily.

A further object of the invention is to be able to plane relatively endless lengths of timber.

Another object of the invention would be to generally square unsquare timbers.

In accordance with a preferred embodiment of the present invention, a machine for planing large wood products comprises a set of planer knives driven by a power source, a set of rollers before and after the knives for self feeding the planer down the wood product, a flat surface each in front and behind the rollers and cutting knives for stability and smoothness, a means for adjusting the rollers in relation to the cutters for depth of cut, a means for adjusting the cutting unit in relation to the flat bearing surfaces, centering guides to keep the unit balanced on the work piece, and handles for carrying. The planer can have brackets on the sides extending partially under the wood being planed for planing to an accurate thickness.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENT

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
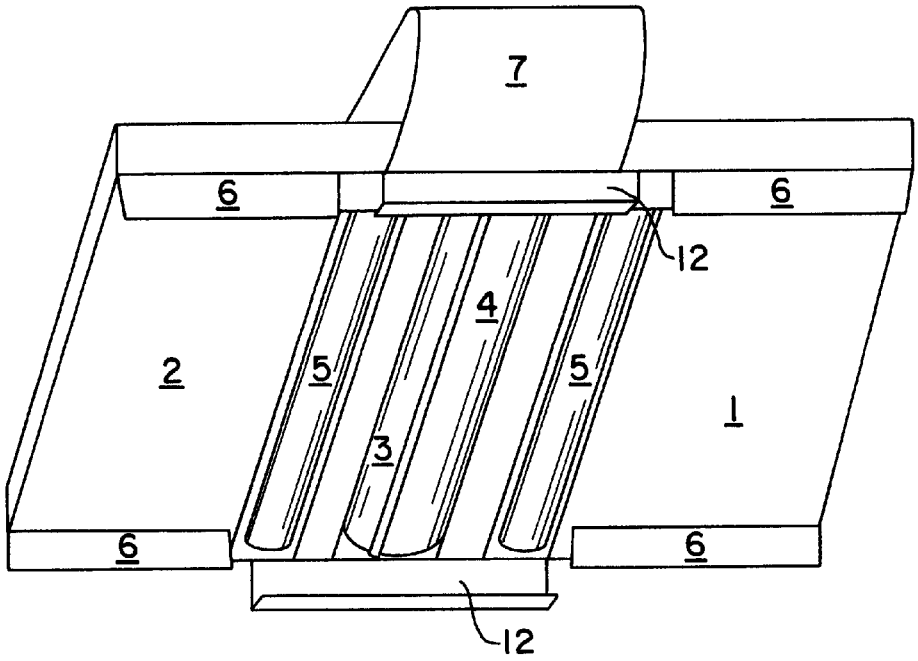
FIG. 1 is a perspective view of the planing device from the underside.
Figure 2:
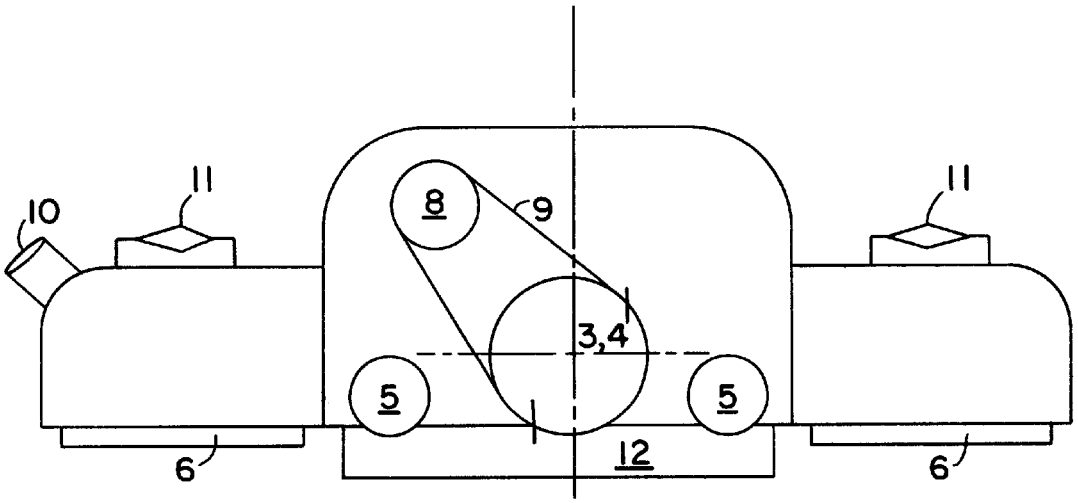
FIG. 2 is a side view of the invention with feed roller, cutter and drive locations.
Figure 3:
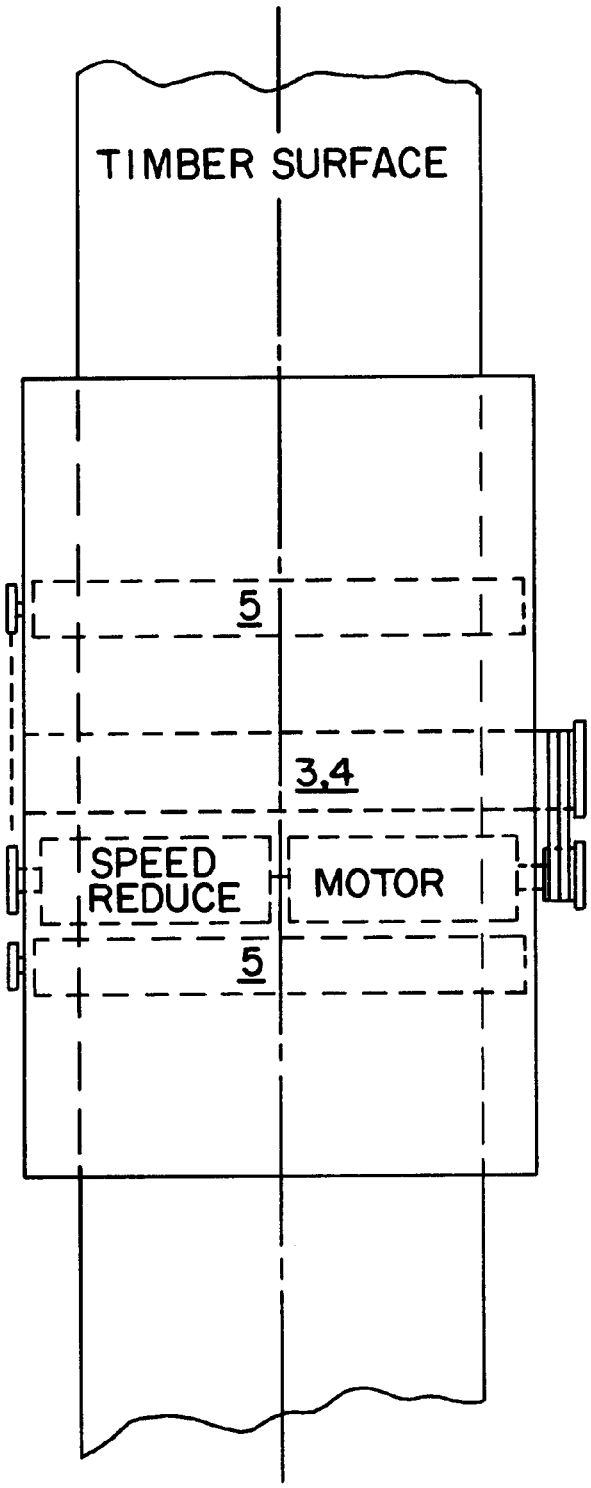
FIG. 3 is a plan view of the invention sitting on a timber.

Turning first to FIG. 1 there is shown the underside of the planer, there is seen the rotating knife retainer 4 driven by a power source with the planer knives 3 and the feed rollers 5, connected to the power source but reduced in speed, these elements are basic planer design for bench top and floor model planers. In the present illustration however, using the preferred construction in conjunction with the on-bearing surface 2 and the off-bearing surface 1 these components make a new and very useful planing machine.

The present invention may be used for planing up to 12½" wide and relatively endless length heavy timbers almost effortlessly because the planer moves down the timber on its own power.

This is accomplished in the present instance by the feed rollers 5 and their proximity to the flat bearing surfaces 1, 2 and rotating cutters 3, 4. The rollers are slightly lower than the bearing or stabilizing surfaces enabling them to get traction on the beam or timber while at the same time the stabilizing surfaces keep the planer from rocking and bumping and at the same time the planer knives 3 are adjusted slightly lower than the rollers allowing them to shave the rough wood smooth and at the same time the guides or bumpers 6 are adjusted to a little wider than the beam or timber, thus keeping the planer centered on the material.

In the preferred embodiment, the user will set the on-bearing surface onto the timber and move it straight onto the work piece until the feed roller gets traction, the knives will begin to shave the wood, the rear feed roller will move onto the work piece then the off-bearing surface makes contact and the planer is on its own to do its work. Following this preferred procedure, the feed rollers and the stabilizing surfaces can be adjusted at a slight angle to the planer knives to remove more wood on one side than the other to square up a timber that is a parallelogram.

Another method of using the device is to install brackets 12 on the sides of the planer housing 7. The brackets will project slightly under the work piece or beam or timber causing the planer to shave to a consistent thickness in relation to the bottom of the beam. Using this method, the work piece is set on supports slightly narrower than itself, enabling the brackets to pass with no interference. The feed rollers working in conjunction with the brackets allow for the planer to do what no other hand held power planer can do.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A machine for planing large wood timbers or other heavy wood products easily comprising:

a set of planer knives driven by a power source;

a set of rollers before and after the knives for self feeding the planer down the work;

a flat surface in front and behind the rollers and cutting knives for stability and smoothness; and centering guides to keep the unit balanced on the work piece.

2. A machine for planing large wood timbers or other heavy wood products easily as claimed in claim 1 further comprising brackets on each side of the said planer extending partially under work piece for the purpose of planing said work piece to an exact thickness.

* * * * *